United States Patent [19]

Reynard

[11] 4,311,881

[45] Jan. 19, 1982

[54] ELECTROSTATIC TRANSDUCER BACKPLATE HAVING OPEN ENDED GROOVES

[75] Inventor: John M. Reynard, Framingham, Mass.

[73] Assignee: Polaroid Corporation, Cambridge, Mass.

[21] Appl. No.: 54,983

[22] Filed: Jul. 5, 1979

[51] Int. Cl.[3] ..... H04R 19/00

[52] U.S. Cl. ..... 179/111 R; 179/111 E

[58] Field of Search ..... 179/111 R, 111 E

[56] References Cited

U.S. PATENT DOCUMENTS

| | | | |
|---|---|---|---|
| 3,373,251 | 3/1968 | Seeler | 179/111 R |
| 3,930,128 | 12/1975 | Fidi et al. | 179/111 R |
| 4,070,741 | 1/1978 | Djuric | 179/111 E |
| 4,081,626 | 3/1978 | Muggli et al. | 179/111 R |
| 4,085,297 | 4/1978 | Paglia | 179/111 R |
| 4,199,246 | 4/1980 | Muggli et al. | 354/195 |

*Primary Examiner*—Gerald L. Brigance
*Attorney, Agent, or Firm*—John J. Kelleher

[57] ABSTRACT

The desired groove shape in a backplate of a combination transmitting and receiving, capacitance type, electrostatic transducer are more consistently reproduceable in a die forming operation by utilizing an open ended grooved configuration so that groove shape deforming lubricating fluid, necessary in said die forming operation, and air, can escape from between the die tool and the transducer backplate through said open ended grooves as said grooves are die formed on said backplate.

3 Claims, 7 Drawing Figures

ELECTROSTATIC TRANSDUCER BACKPLATE HAVING OPEN ENDED GROOVES

BACKGROUND OF THE INVENTION

1. Field of the Invention

The present invention relates to combination transmitting and receiving, capacitance type, electrostatic transducers capable of transmitting and receiving a burst of ultrasonic energy in general, and to the configuration of the grooves in the backplate member of such transducers, in particular.

2. Description of the Prior Art

A capacitance type electrostatic transducer capable of transmitting ultrasonic energy and sensing a reflection or echo of said transmitted energy, is described in U.S. Pat. No. 4,081,626 to MUGGLI, et al. In such a transducer, a thin plastic film, metallized on one surface to form an electrode, is stretched over a relatively massive metallic counter-electrode, hereinafter termed the backplate, with the non-conductive surface of said film in contact with said backplate. The metallized surface of the film separated by the insulating film from the backplate defines a capacitor such that when a dc bias voltage is applied across the electrodes of this capacitor, irregularities on the surface of the backplate set up localized concentrated electric fields in the film. When a signal is superimposed on the dc bias during a transmission mode of operation, the film is stressed and oscillatory formations develop, causing ultrasonic energy or an "acoustical" wavefront to be propagated from the film with its metallized surface, said combination also being referred to herein as a diaphragm. During the receive mode, varying ultrasonic pressure waves on the diaphragm deform the insulating film, thereby producing a variable voltage across said electrodes.

The above-mentioned irregular transducer backplate surface includes a plurality of concentric, circular grooves, regularly spaced from one another, whose dimensions materially affect a transducer's ultrasonic energy transmission pattern. When great numbers of electrostatic transducers are fabricated for use in mass produced systems, such as the ultrasonic ranging system for an automatically focused camera disclosed in U.S. patent application Ser. No. 3,371, filed Jan. 5, 1979, by J. MUGGLI, now U.S. Pat. No. 4,199,246, it is essential that the transmission patterns of such transducers be uniform or consistent so that approximately the same ultrasonic energy transmission pattern will result from a particular transducer drive signal from one transducer to another. A transmission pattern that is, for example, larger or smaller than a desired or expected transmission pattern, may render a system incorporating an ultrasonic transducer with either of such patterns ineffective.

Presently available electrostatic transducer backplates are normally produced by a die forming operation in which a piece of metal usually disc-shaped and softer than that of the die metal, has the above-mentioned concentric grooves pressed into one side thereof. A die lubricant is applied to the die to facilitate movement of the die-formed portion of said disc-shaped piece of metal or workpiece during said die forming operation and for removal of said workpiece after completion of said die forming operation. As an annular or circular groove shape is pressed into the blank metallic disc during a die forming operation, the die lubricant and air become trapped in each circular groove, between the groove forming die tool and said workpiece. This trapped lubricant is relatively incompressible and because of this property, the pressurized lubricant, and to a much lesser extent the trapped pressurized air, cause a non-uniform and unpredictable increase in groove size (primarily groove depth) as the grooves are die formed. This increased groove size can detrimentally effect the size, shape and/or predictability of the ultrasonic energy transmission pattern of an electrostatic transducer that utilizes such a backplate.

SUMMARY OF THE INVENTION

In accordance with the teachings of the present invention, the backplate of a capacitance type, electrostatic transducer incorporates open ended linear grooves to avoid groove shape enlargement caused by a necessary die lubricant and air that become trapped between the die tool and the backplate as said grooves are die formed on said backplate. The grooves form intervening lands or projections which extend fully across a major backplate surface. By employing an open ended backplate groove configuration, the excess die lubricant and the air are able to escape from between the die tool and the backplate and out through the open groove end as the groove shape is formed on said backplate, which results in a more precise transfer of the groove shape of the die tool to said major backplate surface.

DESCRIPTION OF THE PREFERRED EMBODIMENT

Figure 1:
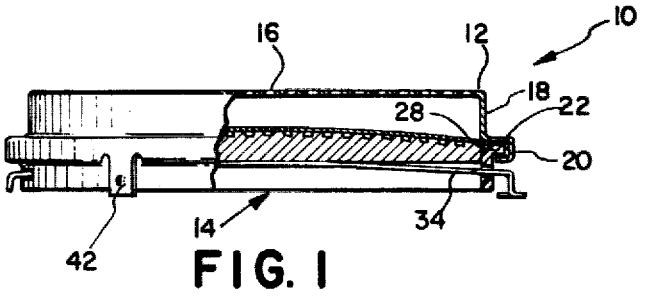
FIG. 1 is an elevational view, partly in section, of an electrostatic transducer assembly incorporating the preferred backplate groove configuration of the present invention.
Figure 2:
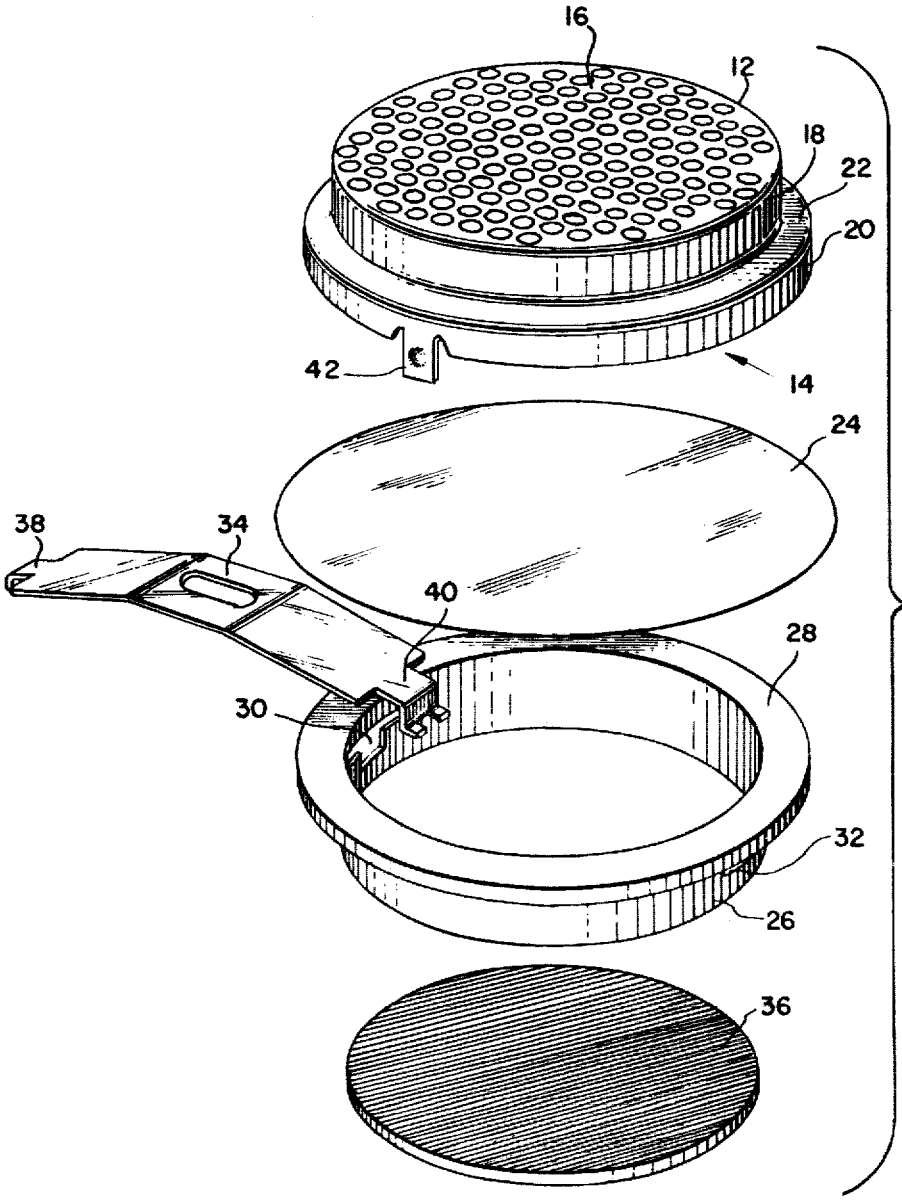
FIG. 2 is an exploded perspective view of the electrostatic transducer assembly of FIG. 1.

Referring now to the drawings, and specifically to FIGS. 1 and 2, reference numeral 10 designates an electrostatic transducer assembly incorporating a preferred embodiment of the inventive concept of the present invention. FIG. 1 is an elevational view, partly in section, of transducer assembly 10 fully assembled; and FIG. 2 is an exploded perspective view of said transducer assembly 10. Transducer assembly 10 includes cover 12, having open end 14 and screen end 16, said cover 12 having two cylindrical portions 18 and 20, of different cross sectional diameters, with shoulder portion 22, intermediate of said two cylindrical portions, lying in a plane that is parallel to the screen, in screen end 16 of cover 12.

Circular diaphragm 24 is formed of a relatively thin plastic dielectric film material, such as the film material sold under the trade name Kapton or the like, with said film material being metallized on one side.

Plastic inner ring 26, which is a main support housing of transducer 10, is of cylindrical shape, of circular cross-section, and has flange 28 extending laterally outward from one end thereof. A pair of T-shaped spring mounting slots 30, 32, for mounting and retaining diaphragm tensioning spring 34, project through the cylindrical wall of said housing 26, and are located diametrically opposite from one another on the wall of said housing 26.

Diaphragm 24 is inserted into open end 14 of cover 12 with its metallized surface facing screen end 16 of said cover 12 to the point where an annular region of said diaphragm 24 rests on shoulder portion 22. Flanged end 28 of inner ring 26 is then inserted into said open end 14 of cover 12 to the point where said flanged end 28 uniformly presses on the non-metallized surface of diaphragm 24. The periphery of diaphragm 24 and flanged end 28 of inner ring 26 have been placed in a fixed relation with respect to cover 12 by crimping or bending the open end of cover 12 until said diaphragm periphery and inner ring flange 28 are fixedly sandwiched between shoulder portion 22 of cover 12, and the bent or crimped end of said cover 12.

Metallic backplate 36, a relatively massive and substantially inflexible circular disc, has a concave surface on one side and a convex surface with a multiplicity of linear grooves on the side opposite said concave surface side. The reason for the convex surface of backplate 36 being to enhance subsequent, uniform contact with diaphragm 24. The convex surface of said backplate 36 with its multiplicity of linear grooves is the situs of the structural features embodying the inventive concept of the present invention, and therefore said convex surface will be described below in much greater detail.

Backplate 36, with its grooved convex surface facing diaphragm 24, is inserted through the non-flanged end of housing 26 and into contact with the non-metallized surface of said diaphragm 24. With backplate 36 maintained in contact with diaphragm 24, diaphragm tensioning leaf spring 34 is inserted through T-shaped slots 32, 30 to the point where tongue-like ends 38, 40 spring down into the vertical portions of said T-shaped slots 30, 32, wherein said leaf spring 34 becomes trapped within the cylindrical wall of housing 26, a position where it maintains backplate 36 in contact with diaphragm 24 and provides the proper tensioning and support of said diaphragm 24.

As explained in the above-cited MUGGLI, et al. patent, a range finding system of the type described in the afore-mentioned application Ser. No. 3,371 provides a dc bias voltage and an ac signal to the metallized surface of diaphragm 24 through connection 42 on metallic cover 12 and to metallic backplate 36 through the connector end of leaf spring 24, causing ultrasonic energy to be transmitted toward an object for object detection purposes. A reflection or echo of this transmitted signal impinging on transducer 10 will cause an object detection signal to appear between connector 42 on cover 12 and the connector end of leaf spring 34. This object detection signal is utilized by the remainder of the range finding system to determine object distance.

Figure 3:
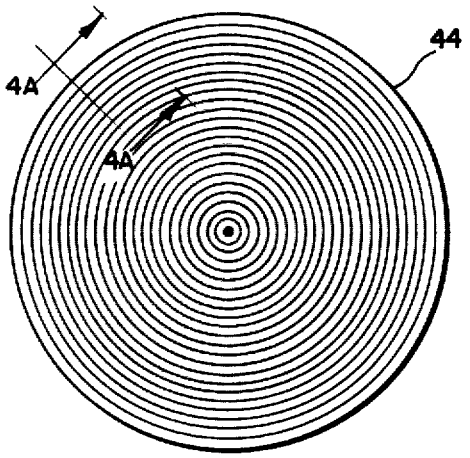
FIG. 3 (PRIOR ART)
FIG. 3 is a top view of a concentric groove transducer backplate constructed in accordance with the teachings of the prior art.
Figure 4A:
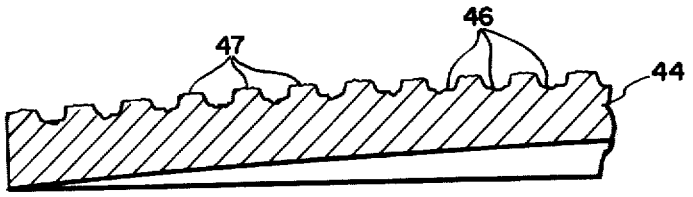
FIG. 4A (PRIOR ART)
FIG. 4A is an enlarged sectional view, in elevation, taken along the line 4A—4A in FIG. 3.
Figure 4B:
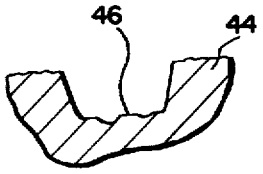
FIG. 4B (PRIOR ART)
FIG. 4B is an enlarged detail of one of the grooves depicted in FIG. 4A.

The diaphragm contacting surface of electrostatic transducer backplates that are presently available in the prior art consists of a plurality of regularly spaced, circular grooves that are concentrically positioned with respect to one another. Backplate 44, illustrated in FIGS. 3, 4A and 4B, is representative of such prior art backplates. An attempt is made to carefully control backplate groove dimensions in order to insure that approximately the same ultrasonic energy transmission pattern will result from great numbers of electrostatic transducers when they are subjected to the same electrostatic transducer drive signal. A transducer pattern that is larger or smaller than a desired or expected transmission pattern or more or less intense at a particular location within said pattern, may erroneously detect or not detect a particular object outside of or within said desired or expected transmission pattern, which could result in a false object detection signal being generated in, for example, the automatic focusing system in the photographic camera described in the above-cited MUGGLI application. The generation of a false object detection signal in said focusing system may result in camera lens misfocusing.

Presently available electrostatic transducer backplates are normally produced by a die forming operation in which a disc-shaped piece of metal, softer than that of the die metal, has the above-mentioned concentric grooves pressed into one side thereof. A die lubricant is applied to the die to facilitate movement of the die-formed portion of said disc-shaped piece of metal or workpiece, during the die forming operation and the removal of said workpiece from said die. As the concentric, and therefore closed end, groove shape is pressed into the blank metallic disc during a die forming operation, the die lubricant and air become trapped in each concentric groove, between the groove forming die tool and said workpiece. This trapped lubricant is relatively incompressible and because of this property, the pressurized lubricant and to a much lesser extent the trapped air, cause a non-uniform increase in groove size (primarily groove depth) as the backplate grooves are die formed. This phenomenon is illustrated in prior art FIGS. 4A and 4B.

FIG. 4A is an enlarged sectional view, in elevation, of a prior art annular or circular groove backplate 44 which is a view taken along the line 4A—4A in FIG. 3. FIG. 4B is an enlarged detail of one of the circular grooves depicted in FIG. 4A. With reference to FIGS. 4A and 4B, the bottom surfaces 46 of the circular grooves in FIG. 4A are irregularly shaped, causing an increase in groove size primarily because of the use of a die lubricant on the die tool during the backplate die forming operation as previously explained. Surface 47 is also irregularly formed during the die forming operation because of the trapped lubricant and air, but to a lesser degree. This increased groove size can detrimentally effect ultrasonic energy transmission pattern size, shape and/or predictability and result in, for example, the false object detection signal mentioned above. The location of these irregularities in the circular grooves is random and therefore it is impossible to predict, with any degree of certainty, what effect such irregularities will have on the size and/or intensity of the ultrasonic energy transmission pattern of the transducer in which it is employed. This irregular grooved surface is shown in much greater detail in the enlarged circular backplate groove depicted in FIG. 4B.

Figure 5A:
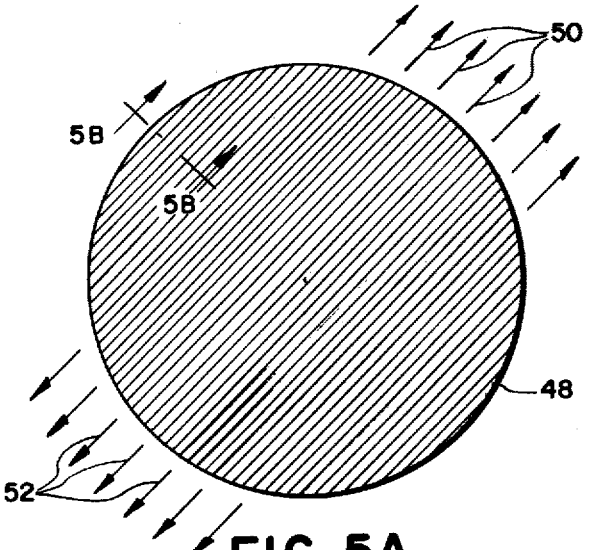
FIG. 5A is a top view of a transducer backplate incorporating linear grooves in accordance with a preferred embodiment of the present invention.
Figure 5B:
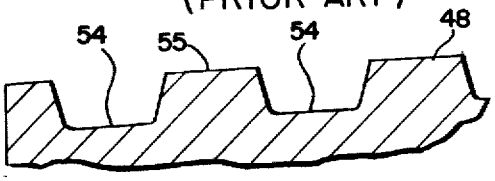
FIG. 5B is an enlarged sectional view, in elevation, taken along the line 5B—5B in FIG. 5A.

The inventive concept of the present invention includes a transducer backplate having grooves on the diaphragm contacting backplate surface that extend fully across said backplate surface forming channels in said backplate surface such that both ends of each groove are open. Transducer backplate 48 in FIGS. 5A and 5B is a backplate having such open ended grooves. With reference to said FIGS. 5A and 5B, the grooves formed in said backplate 48 are linear, are regularly spaced, and are parallel to one another. By utilizing an open ended groove configuration such as that of backplate 48, the excess die lubricant that is applied to the die tool when forming grooves on a transducer backplate in a die forming operation and trapped air are able to escape through the ends of such open ended grooves in the direction 50, 52, which are schematically illustrated in FIG. 5A. By allowing the excess die lubricant and air to escape from between the backplate and the die tool through the open ended backplate grooves, the die lubricant and air will not be compressed during the die forming operation and a more precise impression of the groove shape of the die tool will be made on the transducer backplate. Furthermore, this linear groove configuration does not alter the transmit or receive signal from that of an equivalent prior art transducer backplate with annular or circular closed end grooves such as prior art backplate 44 in FIG. 3. FIG. 5B, which is a view taken along the line 5B—5B in FIG. 5A, shows the improved groove shape that results when the transducer backplate grooves are open ended. As shown in said FIG. 5B, surfaces 54 and 55 on backplate 48 are relatively smooth and regular when compared with the irregular surfaces 46 and 47 of prior art backplate 44 illustrated in FIGS. 4A and 4B. Die tools that form linear grooves in a transducer backplate can be made with a grinding tool as well as by more traditional die tool forming methods such as electric discharge machining. Furthermore, the dimensions of a transducer backplate with linear grooves can be readily and nondestructively tested on a shadowgraph or comparator.

Other linear or non-linear open ended groove configurations may be employed, but the preferred backplate groove configuration is the linear groove configuration formed in backplate 48. However, it is possible to mass produce large numbers of combination transmitting and receiving, capacitance type, electrostatic transducers having fairly consistent and/or predictable ultrasonic energy transmission patterns if any open ended transducer backplate groove configuration is employed.

It will be apparent to those skilled in the art from the foregoing description of my invention that various improvements and modifications can be made in it without departing from its true scope. The embodiment described herein is merely illustrative and should not be viewed as the only embodiment that might encompass my invention.

What is claimed is:

1. An electrostatic transducer comprising a relatively inflexible support plate for a flexible diaphragm, said support plate having at least one major irregular surface of conductive material formed in a die forming operation employing a liquid lubricant, said major surface being defined by a series of projections spaced apart by intervening grooves, said grooves and said projections extending fully across said major surface to the peripheral edges thereof so as to provide open channels thereacross between each of said projections to eliminate entrapment of the liquid lubricant in each of said grooves during said die forming operation.

2. The transducer of claim 1 wherein said projections and grooves are parallel linear projections and grooves.

3. The transducer of claim 2 wherein said peripheral edges define a circle.

* * * * *